US006040659A

United States Patent [19]

Masuda et al.

[11] Patent Number: 6,040,659

[45] Date of Patent: Mar. 21, 2000

[54] DISCHARGE LAMP LIGHTING DEVICE

[75] Inventors: Kenichi Masuda; Tsutomu Hasegawa; Fuminori Teramoto, all of Tsurugashima, Japan

[73] Assignee: Toyo Denso Kabushiki Kaisha, Tokyo, Japan

[21] Appl. No.: 09/148,259

[22] Filed: Sep. 4, 1998

[30] Foreign Application Priority Data

Sep. 9, 1997 [JP] Japan ..... 9-284210

[51] Int. Cl.[7] ..... H01J 7/44

[52] U.S. Cl. ..... 315/56; 315/57; 315/326; 336/96

[58] Field of Search ..... 315/56, 39, 51, 315/82, 177, 208, 254, 276, 326, 57, 70; 314/64; 439/874, 876; 336/96, 221

[56] References Cited

U.S. PATENT DOCUMENTS 5,118,990 6/1992 Makita ..... 315/56
5,600,208 2/1997 Katou et al. ..... 315/56
5,959,521 9/1999 Kohmura et al. ..... 336/96

FOREIGN PATENT DOCUMENTS 8-130127 of 1996 Japan .

*Primary Examiner*—Don Wong
*Assistant Examiner*—Thuy Vinh Tran
*Attorney, Agent, or Firm*—Lyon & Lyon LLP

[57] ABSTRACT

A discharge-lamp lighting device has a housing with a power supply socket formed therein and accommodating a printed circuit board with a coil case having a primary coil formed by plural parallel plate-conductors insert-molded around the body thereof and a discharge lamp socket integrally fitted thereon and including a secondary coil therein. A lamp lighting circuit is formed by mounting the coil case on the printed circuit board. The discharge lamp lighting device is formed as a single solid device by potting all the components in the housing with insulating resin poured in a melted state and solidified therein, thus eliminating the need of providing a high-voltage cable between the circuitry and the lamp socket.

7 Claims, 7 Drawing Sheets

DISCHARGE LAMP LIGHTING DEVICE

BACKGROUND OF THE INVENTION

The present invention relates to a discharge-lamp lighting device used as headlights of a vehicle and the like.

With conventional discharge lamps (FIG. 12) used as headlights of a vehicle, lamp sockets 1 are provided in respective lamp-mounting places of the vehicle and lamp-lighting devices 15 each containing a high-voltage generating transformer with a control circuit assembled on a printed circuit board are separately mounted in a bonnet of the vehicle. The lamp-lighting lighting devices 15 are connected to the respective lamp sockets by using separate high-voltage cables 16 and low-voltage cables 17.

Japanese Laid-open Patent Publication No. 8-130127 discloses a compact discharge-lamp lighting device constructed as follows:

A coil case has a primary coil formed by plural plate conductors (insertions) molded thereon and contains therein a secondary-coil wound bobbin with a core inserted in a hollow center thereof and potted therein with insulating resin to form a solid coil case unit. The coil case unit is then mounted on a printed circuit board having a circuit component pattern to finish a discharge lamp lighting circuit. The printed circuit board is further provided with a shield portion for protecting the circuit elements against the possible effects of the high-voltage generating portion in the coil case unit.

As described above, the conventional discharge lamp lighting device requires separate arrangement of a lamp socket apart from the lamp lighting circuit unit and interconnection of them by using a high-voltage cable. This complicates the mounting work of the lighting device.

Furthermore, the use of elongated high-voltage cable may be associated with the risk of a leak current therefrom and reduction of the output voltage of the discharge lamp lighting device.

SUMMARY OF THE INVENTION

Accordingly, an object of the present invention is to provide a discharge-lamp lighting device that is compact and easy to mount with no need for providing and connecting a high-voltage cable by forming a single solid unit in which a lamp lighting circuit with a high-voltage portion mounted thereon is connected to a discharge lamp socket. The discharge lamp lighting device is constructed as follows: A coil case having a primary coil formed by plural plate-conductor insertions molded in parallel to each other around the coil case and containing a secondary-coil-wound bobbin with a core inserted in a hollow center thereof is mounted on a printed circuit board to form a discharge-lamp lighting circuit pattern together with circuit elements assembled thereon and a primary coil circuit pattern by connecting the plural plate-conductors in series therewith, thus forming an inner assembly of the device. The inner assembly is then placed in a housing having a power supply socket formed therein so that the top portion of the lamp socket is projecting from the housing and an input terminal of the primary coil is connected to a primary terminal. The inner assembly is finally potted in the housing with insulating resin poured in a melted state and solidified therein to form a single solid device.

DETAILED DESCRIPTION OF THE PREFERRED EMBODIMENTS

Figure 1:
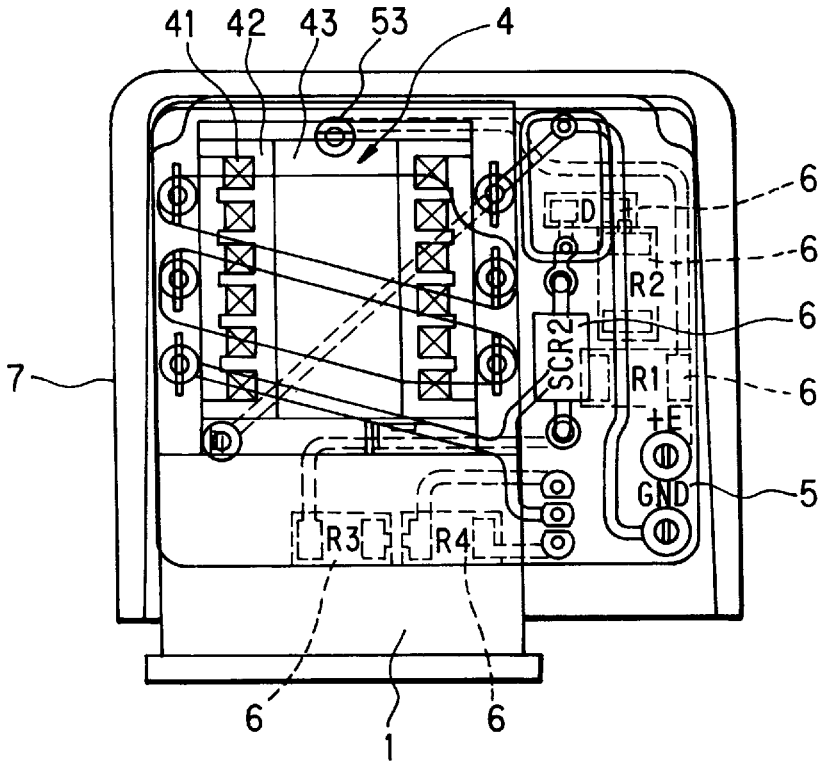
FIG. 1 is a plan view of a discharge lamp lighting device according to an aspect of the present invention.
Figure 2:
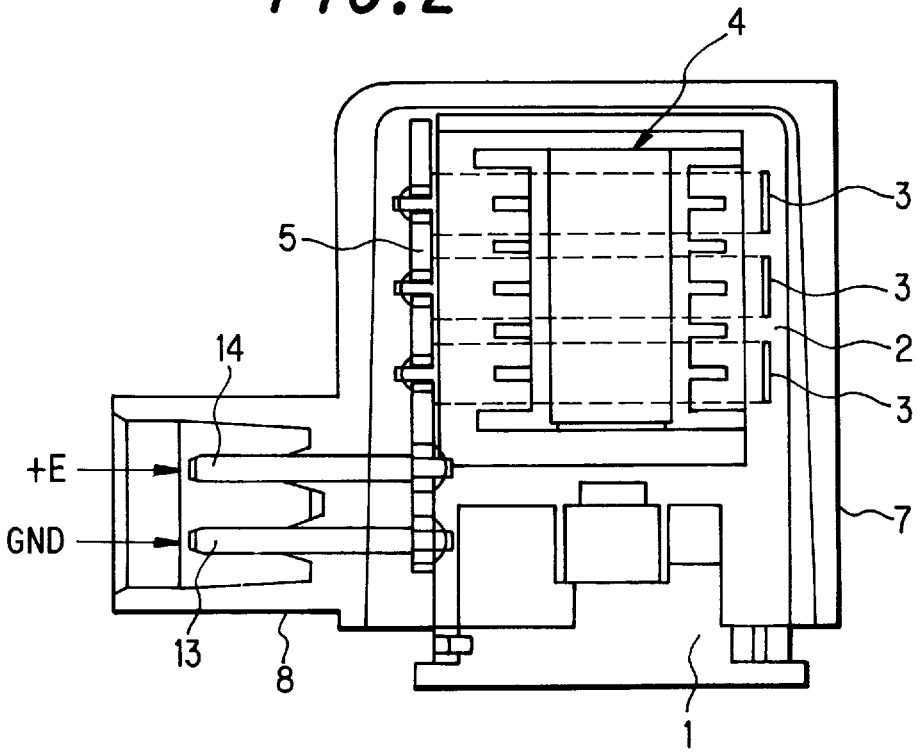
FIG. 2 is a side view of the discharge lamp lighting device of FIG. 1.
Figure 3:
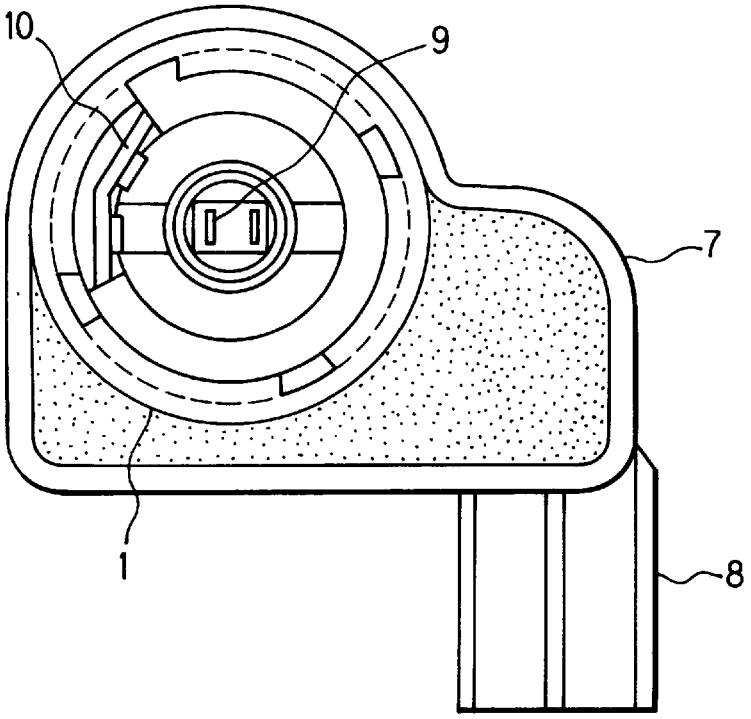
FIG. 3 is a front end view of the discharge lamp lighting device of FIG. 1.

The preferred embodiments of the present invention will now be described in detail by way of example and with reference to the accompanying drawings.

In FIGS. 1 to 5, a discharge lamp lighting device according to the present invention comprises a housing 7 having a power supply socket portion 8 integrally formed thereon and an inner assembly consisting a coil case 2 having three U-shaped plate-conductors 3 formed around the coil-case body by an insert molding method and a discharge-lamp socket 1 coaxially fitted thereto. A secondary coil unit 4 is mounted in the coil case 2 and connected at its output terminal to a terminal of the discharge-lamp socket 1. A printed circuit board 5 having a discharge lamp lighting circuit pattern with elements 6 and a primary coil circuit pattern thereon is mounted and connected at the three plate-conductors in series with the primary coil pattern. The inner assembly is mounted in the housing 7 in such a manner that the discharge lamp socket 1 has a top portion protruding from the housing 7 and an input terminal of the primary coil is electrically connected to a terminal of the power supply socket 8 of the housing 7. The inner assembly is then potted in the housing 7 with insulating resin poured in a melted state and solidified therein to form a single solid device.

Figure 6:
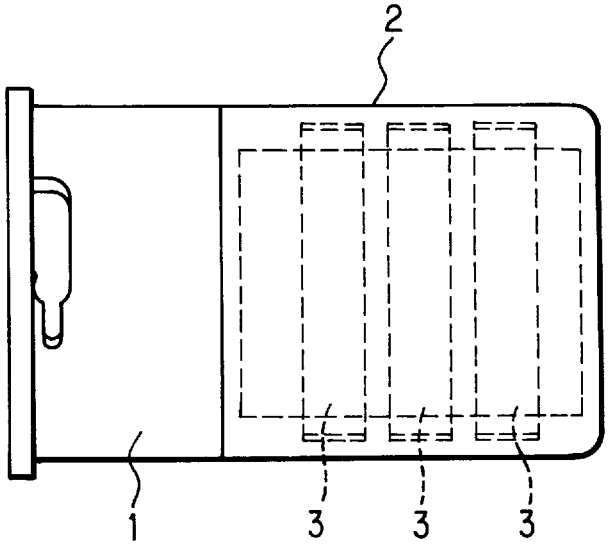
FIG. 6 is a plan view of a coil case of the discharge lamp lighting device of FIG. 1.
Figure 7:
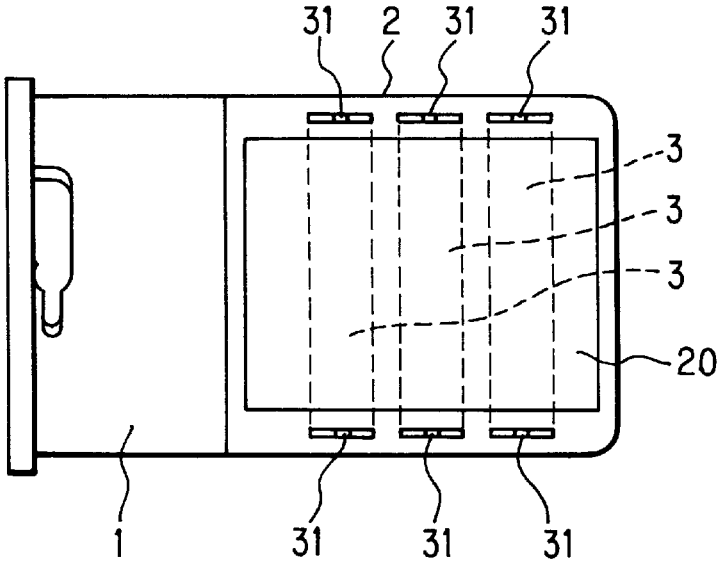
FIG. 7 is a bottom view of the coil case of FIG. 6.
Figure 8:
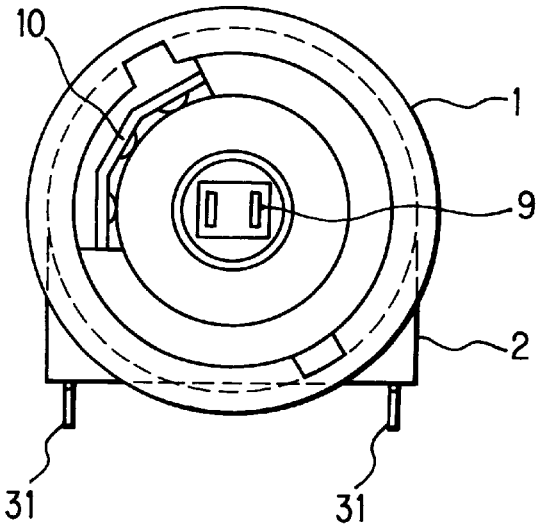
FIG. 8 is a front end view of the coil case of FIG. 6.

FIGS. 6 to 8 illustrate a coil case 2 having a discharge-lamp socket 1 coaxially disposed and integrally fitted thereon.

The coil case 2 is provided at its bottom with an opening 20 for receiving the secondary coil unit 4 and with projecting terminal pins 31 of respective conductor plates 3 formed around the coil case body.

Figure 10:
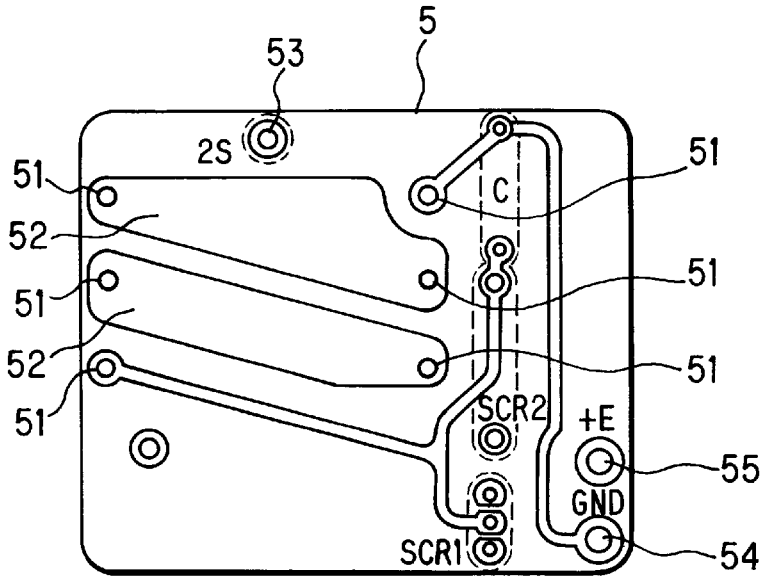
FIG. 10 is a top view of a printed circuit board of the discharge lamp lighting device of FIG. 1.

The coil case 2 is mounted at a given position on the printed board 5 and connected thereto by inserting the terminal pins 31 of the respective conducting plates 3 into corresponding holes 51 formed in the printed board 5 and bonding them therein. The conducting plates 3 are connected in series with the printed pattern provided on the printed circuit board 5 to create a primary coil circuit thereon (FIG. 10).

The discharge lamp socket 1 has a high-voltage terminal 9 at a center thereof and a low-voltage terminal 10 around the perimeter thereof.

The secondary coil unit 4 is composed of a coil bobbin 42 with a secondary coil 41 wound thereon and a core 43 inserted in a hollow center thereof.

Figure 4:
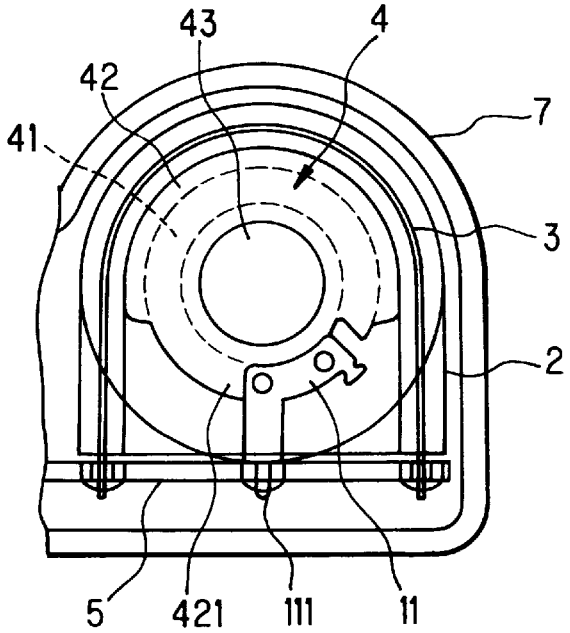
FIG. 4 is a rear end view of the discharge lamp lighting device of FIG. 1.

The coil bobbin 42 is provided at one flanged end 421 with an input electrode 11 to which the starting end of the secondary coil 41 is secured. With the coil case 2 mounted at a specified position on the printed board 5, a terminal pin 111 of the input electrode 11 is inserted into a hole 53 made in the printed board 5 and bonded therein to connect the coil case with a line of an input voltage +E as shown in FIG. 4.

Figure 5:
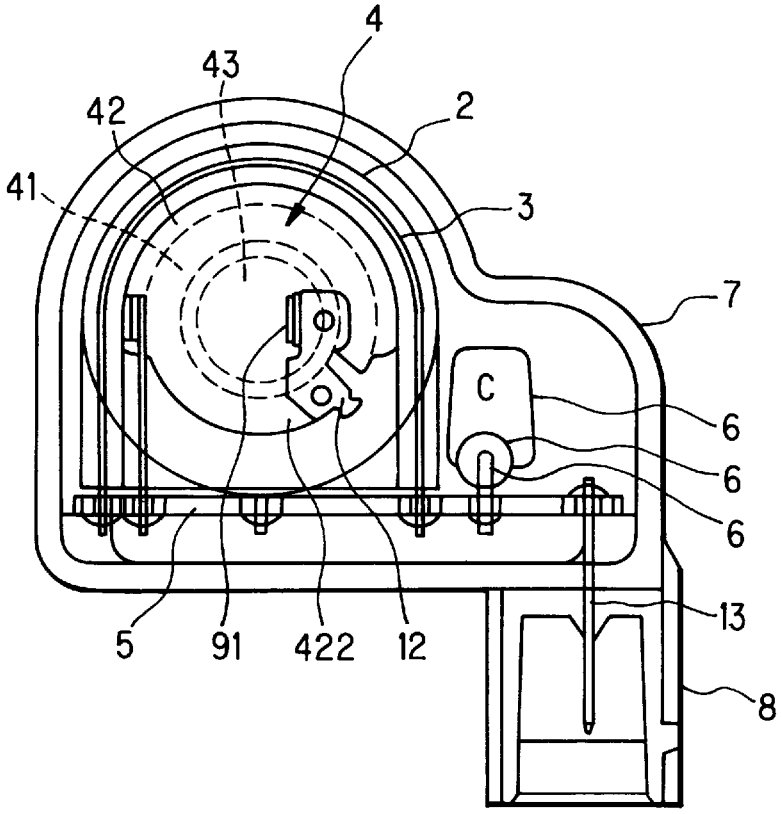
FIG. 5 is a longitudinal view of the discharge lamp lighting device of FIG. 1.

The coil bobbin is also provided at the other flanged end 422 with an output electrode 12 to which the terminating end of the secondary coil is secured. With the coil case 2 mounted at a specified position on the printed board 5, the output electrode 12 is in contact with a rear end 91 of the high-voltage terminal 9 sticking from the discharge lamp socket 1 into the coil case 2 as shown in FIG. 5.

The secondary coil unit 4 is then potted in the coil case 2 with insulating resin poured in a melted state and solidified therein to form a single coil case unit.

Figure 9:
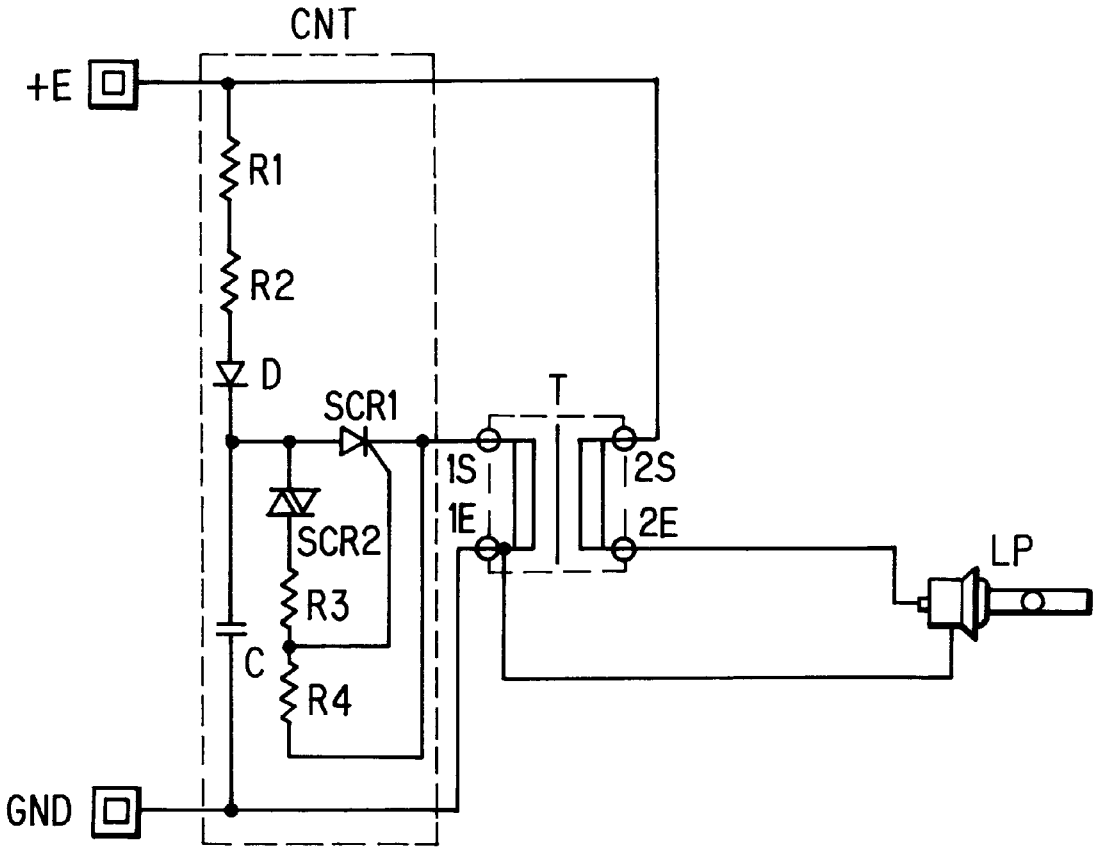
FIG. 9 is a block diagram of a lightning circuit of the discharge lamp lighting device of FIG. 1.
Figure 11:
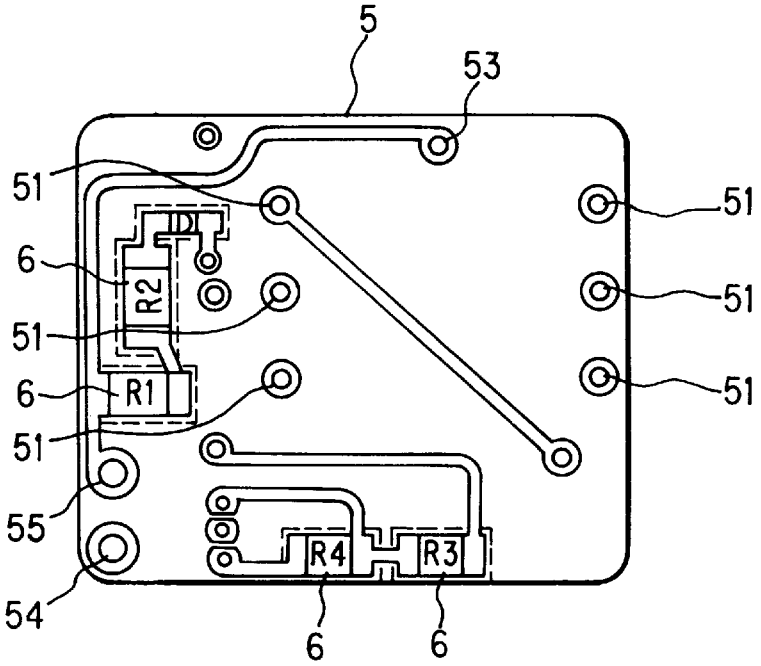
FIG. 11 is a bottom view of the printed circuit board of FIG. 10.
Figure 12:
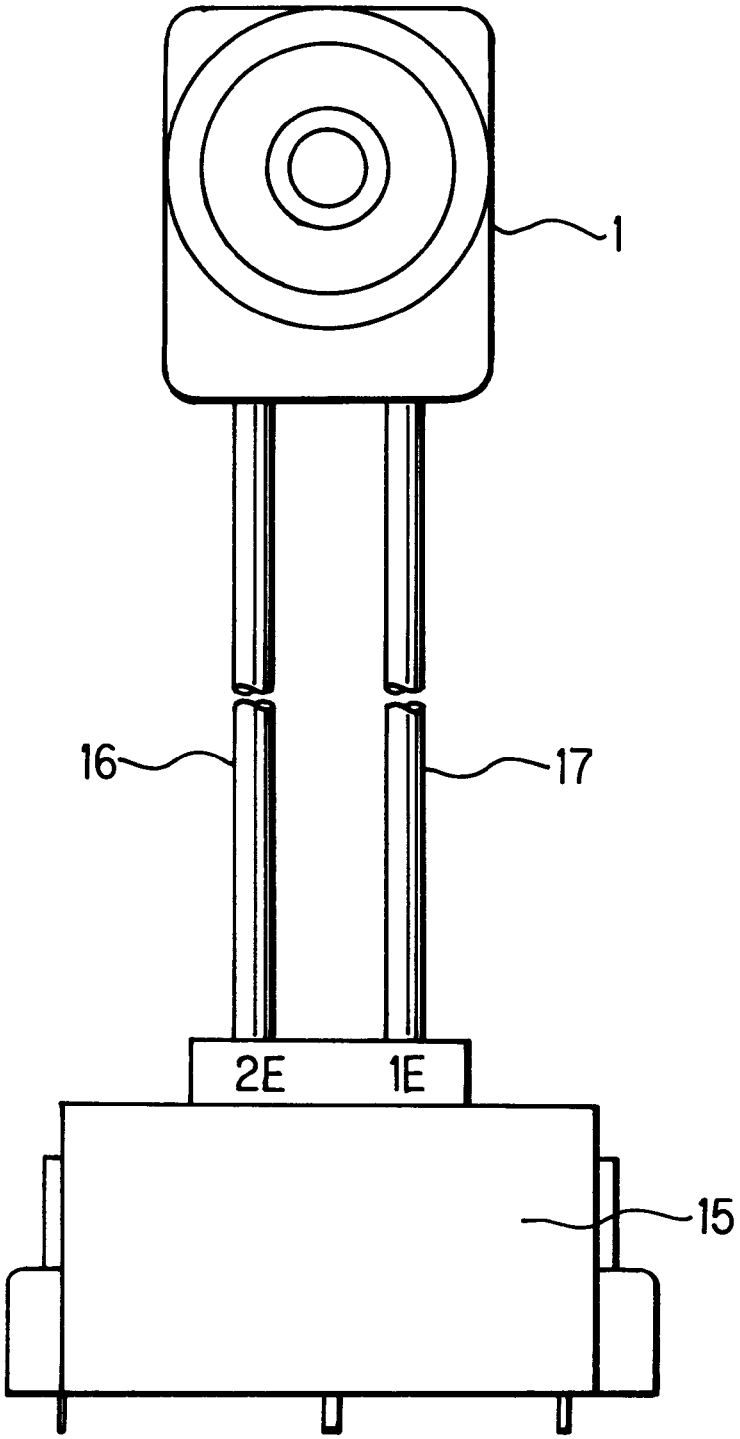
FIG. 12 PRIOR ART
FIG. 12 is a view showing a conventional discharge-lamp lighting device and a discharge lamp socket.

FIG. 9 is illustrative of a lamp-lighting circuit for lighting a discharge lamp LP, which has a control circuit CNT that receives a driving voltage +E (DC 400 V) when a lamp switch (not shown) is turned on and the controlled voltage is applied to the primary side of the high-voltage generating transformer T that in turn produces at its secondary side a high voltage (about 25 KV) for lighting the discharge lamp. After lighting the discharge lamp by applying the high voltage for an initial firing period, the control circuit CNT operates to directly supply the discharge lamp with a working voltage (100 V) through the secondary side coil of the high-voltage generating transformer T to maintain the lamp in a lightning mode. FIGS. 10 and 11 show a printed circuit board 5 implemented with a discharge lamp lighting circuit. FIG. 10 is illustrative of the top surface of the printed board 5, whereon a coil case 2 containing a secondary coil unit 4 is mounted and circuit elements 6 such as thyristors SCRI and SCR2 and a capacitor C for a control circuit CNT are also mounted.

FIG. 11 is illustrative of the bottom surface of the printed circuit board 5, whereon circuit elements 6 such as resistors R1, R2, R3, R4 and diodes for the control circuit CN are mounted. All of the circuit elements are interconnected by wiring patterns printed on the printed board 5 to form the discharge-lamp lighting circuit shown in FIG. 9.

The printed circuit board 5 has a pair of holes 54 and 55 made therein for connection of a grounding terminal GND and a driving voltage terminal +E respectively. With the printed circuit board 5 mounted in the housing 7, rear-end pins of the terminals 13 and 14 of the power supply socket 8 of the housing are fitted in the corresponding holes 54 and 55 of the printed circuit board 5 to complete the electrical connection between the printed board 5 and the housing 7 as shown in FIG. 1.

In the discharge-lamp lighting device according to the present invention, the conducting plates 3 formed around the coil case 2 can also serve as an electromagnetic shield for effectively protecting all the surrounding electric components from the possible unwanted effect of the high-voltage produced for initial firing of the discharge lamp LP.

In the discharge lamp lighting device, the coil case 2 with the discharge lamp socket 1 integrally fitted thereon allows the secondary coil unit 4 to directly connect its output terminal of the secondary coil with the high-voltage terminal 9 of the discharge lamp socket 1 therein by merely fitting the secondary coil unit 4 in the coil case 2. This eliminates the need for wiring of a high-voltage circuit on the printed board 5 and the need for providing and connecting a high-voltage cable between the discharge lamp socket and the output end of the secondary coil. The optimal high-voltage connection is thus realized.

The discharge lamp lighting device is compact and can be directly mounted in a limited space of a headlight mounting portion of the vehicle. This lighting device is easy to assemble since it requires only the connection of a power source to the power-supply socket 8 formed thereon, eliminating the need for using an elongated high-voltage cable.

As is apparent from the foregoing, the discharge lamp lighting device according to the present invention is advantageous in its compact single-unit design which is realized by mounting a secondary coil in a coil case with a discharge lamp socket integrally fitted thereto and plural conducting plates insert-molded around the body thereof to form a primary coil serving also as shield plates, attaching the coil case onto a printed circuit board implemented with circuit elements to form a discharge-lamp lighting circuit thereon, mounting the printed circuit board with the coil case and circuit elements into a compact housing provided with a power supply socket fitted therein and potting the printed circuit board with the coil case in the housing with insulating resin poured in melted state and solidified. The electrical connection between component units of the device can be realized by merely assembling one unit with another. No additional wiring is required. The effective shield of the high-voltage portion is also achieved by the conducting plates forming the primary coil.

Particularly, the use of the discharge coil case having the discharge lamp socket integrally fitted thereto and suitably connected to the high-voltage portion of the coil case makes a discharge-lamp lighting device compact and easy to mount.

What is claimed is:

1. A discharge lamp lighting device having a housing with a power supply socket integrally formed therein and accommodating therein a discharge-lamp lighting-circuit assembly comprising a printed circuit board with wiring patterns and circuit components comprising a lamp lighting circuit thereon, a coil case mounted on the printed circuit board and connected to said lamp lighting circuit, said coil case having a primary coil formed by plural plate-conductors formed in parallel to each other at an outer surface of said coil case and a discharge lamp socket integrally formed on said coil case, a secondary-coil wound bobbin with a core inserted in a hollow center of said bobbin, wherein said discharge-lamp lighting-circuit assembly is mounted in said housing with a top portion of said discharge lamp socket projecting from an open-end of said housing and is connected at an output terminal of said coil case to said power supply socket formed in said housing and potted in said housing with insulating resin poured in a melted state and solidified therein to form a single solid device.

2. A discharge lamp lighting device comprising, a housing with a power supply socket integrally formed therein, a discharge-lamp lighting circuit assembly having a printed circuit board with wiring patterns and circuit components forming a discharge lamp lighting circuit, a coil case having a plurality of U-shaped plate-conductors positioned in parallel and mounted in said coil case, a discharge lamp socket integrally formed on said coil case, a secondary-coil wound bobbin with a core inserted in a hollow center of said bobbin mounted in said coil case inside of said plate-conductors, said coil case mounted on the printed circuit board and connected to said lamp lighting circuit, and said discharge-lamp lighting circuit assembly and said coil case being installed and permanently mounted in said housing.

3. A discharge lamp lighting device according to claim 2, wherein said printed circuit board includes parallel flat conductors connected to said plate-conductors mounted in said coil case and forming a primary-coil surrounding said secondary-coil wound bobbin.

4. A discharge lamp lighting device according to claim 3, wherein said printed circuit board includes holes at ends of said flat conductors for receiving terminal pins integrally provided on ends of said plate-conductors.

5. A discharge lamp lighting device according to claim 4, wherein said discharge lamp socket is provided with a high-voltage terminal for connecting a discharge lamp on one side and for engaging and electrically connecting to said secondary-coil on another side.

6. A discharge lamp lighting device according to claim 2, wherein said discharge lamp socket is provided with a high-voltage terminal for connecting a discharge lamp on one side and for engaging and electrically connecting to said secondary-coil on another side.

7. A discharge lamp lighting device according to claim 2, wherein said secondary-coil bobbin with said core, said printed circuit board and said coil case are integrally potted together in said housing by resin.

* * * * *